US005253371A

United States Patent [19]

Slawinski

[11] Patent Number: 5,253,371

[45] Date of Patent: Oct. 19, 1993

[54] DEVICE FOR EXHAUSTING FOUL AIR FROM A TOILET

[76] Inventor: Henry G. Slawinski, 240 Mineola Ave., Carle Place, N.Y. 11514

[21] Appl. No.: 833,079

[22] Filed: Feb. 10, 1992

[51] Int. Cl.[5] ..... E03D 9/04; A47K 13/10

[52] U.S. Cl. ..... 4/213; 4/216

[58] Field of Search ..... 4/213, 216, 217, DIG. 3

[56] References Cited

U.S. PATENT DOCUMENTS

| | | | |
|---|---|---|---|
| 2,124,017 | 7/1938 | Vandiver | 4/213 |
| 2,297,035 | 9/1942 | Svec | 4/213 |
| 3,230,551 | 1/1966 | Kopp | 4/213 |
| 3,469,267 | 9/1969 | Kuklok | 4/213 |
| 3,533,112 | 10/1970 | Poister | 4/213 |
| 3,585,651 | 6/1991 | Cox | 4/213 |
| 4,007,498 | 2/1977 | Pearson | 4/213 |
| 4,232,406 | 11/1980 | Beeghly et al. | 4/216 X |
| 5,136,729 | 8/1992 | Ricard | 4/213 |

*Primary Examiner*—Daniel M. Yasich

*Attorney, Agent, or Firm*—Michael I. Kroll

[57] ABSTRACT

A device for exhausting foul air from a toilet of the type having a bowl with a rim, bolt caps for mounting the bowl to a floor, a seat with a hinged cover and a tank with a flush handle and tank lid placed adjacent a wall is provided. The device consists of an intake hose extending from the rear portion of the rim of the bowl below the seat and hinged cover, bottom of the tank and through the wall, an exhaust hose extending upwardly within the wall and a mechanism coupled between the intake hose and the exhaust hose within the wall, for driving a current of air therethrough, so that the foul air within the bowl will be exhausted into the wall.

2 Claims, 2 Drawing Sheets

OPTIONAL
REMOVABLE
ACCESS
PANEL

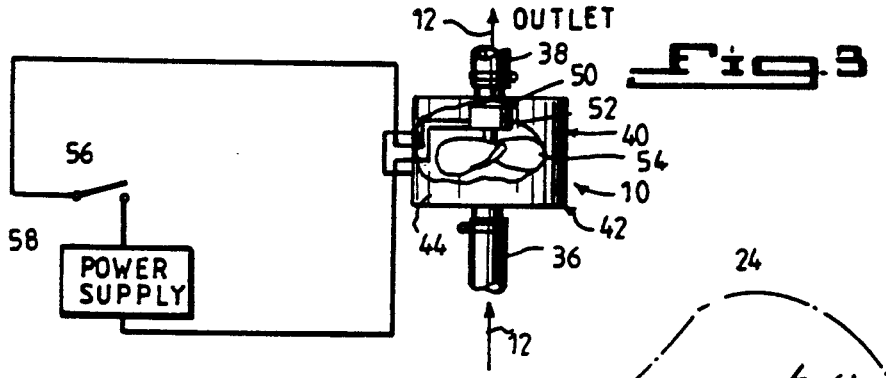
Fig. 3
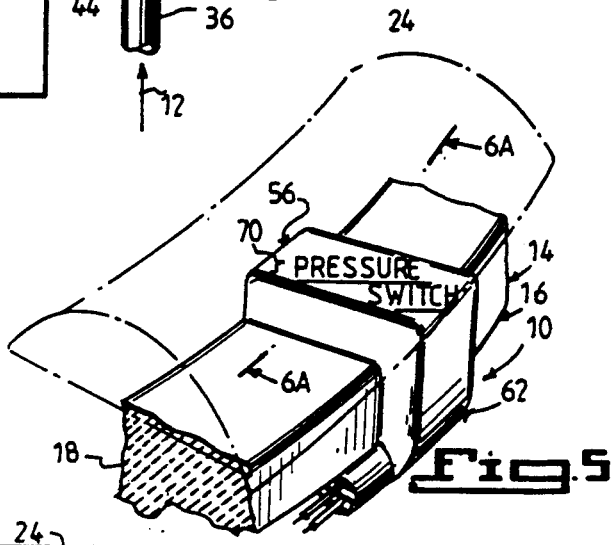
Fig. 5
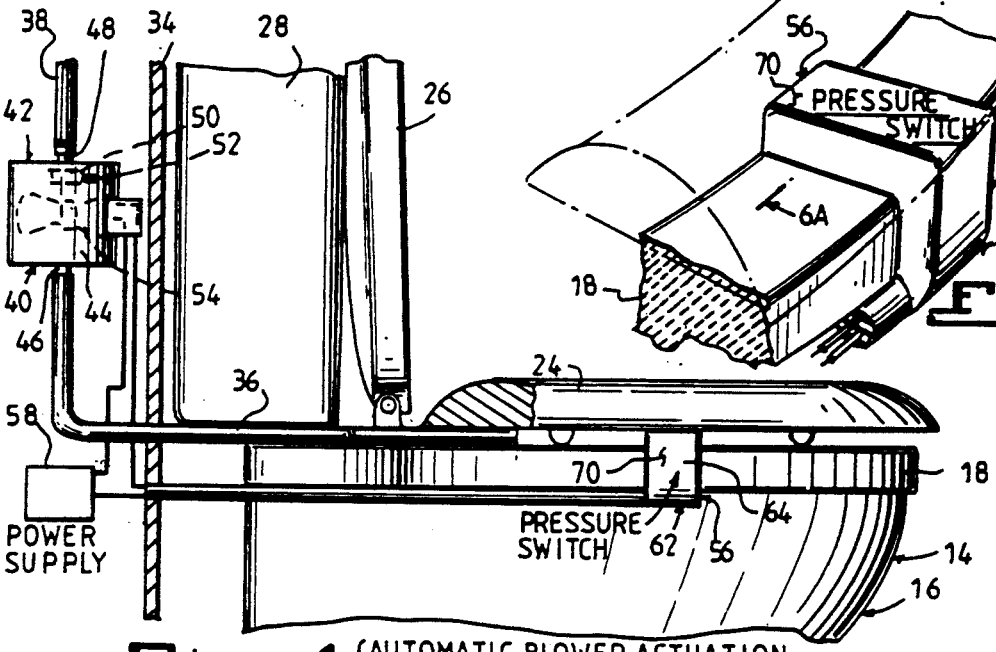
Fig. 4 (AUTOMATIC BLOWER ACTUATION WITH TOILET SEAT OCCUPATION)
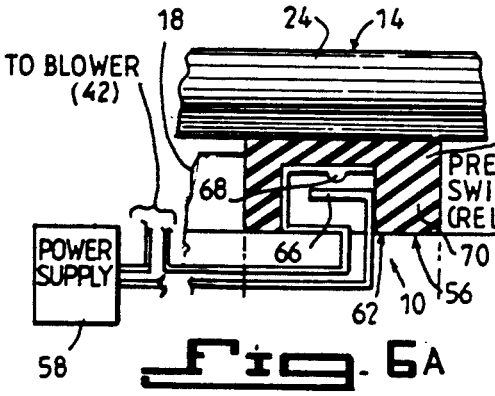
Fig. 6A
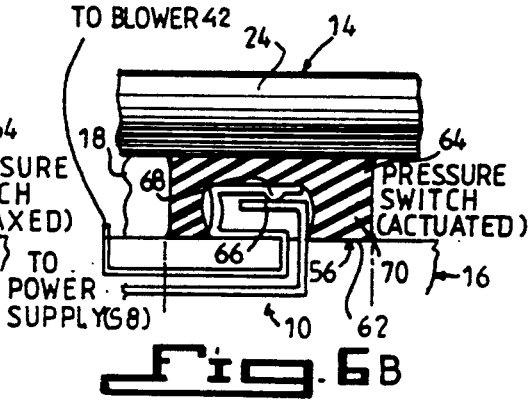
Fig. 6B

DEVICE FOR EXHAUSTING FOUL AIR FROM A TOILET

DESCRIPTION OF THE PRIOR ART

Numerous toilets have been provided in prior art that are adapted to include a mechanism built into the toilets for evacuating odors from the bowls. While these units may be suitable for the particular purpose to which they address, they would not be as suitable for the purposes of the present invention as heretofore described.

SUMMARY OF THE INVENTION

A primary object of the present invention is to provide a device for exhausting foul air from a toilet that will overcome the shortcomings of the prior art devices.

Another object is to provide a device for exhausting foul air from a toilet in which a blower for removing the foul air from the bowl of the toilet will be turned on by a pressure switch when a person sits upon the toilet seat.

An additional object is to provide a device for exhausting foul air from a toilet in which the blower for removing the foul air can be electrically disconnected from the pressure switch by a manually operated on/off switch on a wall next to the toilet.

A further object is to provide a device for exhausting foul air from a toilet that is simple and easy to use.

A still further object is to provide a device for exhausting foul air from a toilet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is a diagrammatic view showing the electrical circuitry for operating the blower.

FIG. 4 is a side view taken in direction of arrow 4 in FIG. 1 with parts broken away and in section.

FIG. 5 is a perspective view of a portion of the rim of the toilet bowl showing the pressure switch installed therein.

FIG. 6A is a diagrammatic cross sectional view through the pressure switch on its off relaxed position.

FIG. 6B is a view similar to FIG. 6A showing the pressure switch in its on actuated position.

DETAILED DESCRIPTION OF THE PREFERRED EMBODIMENTS

Figure 1:
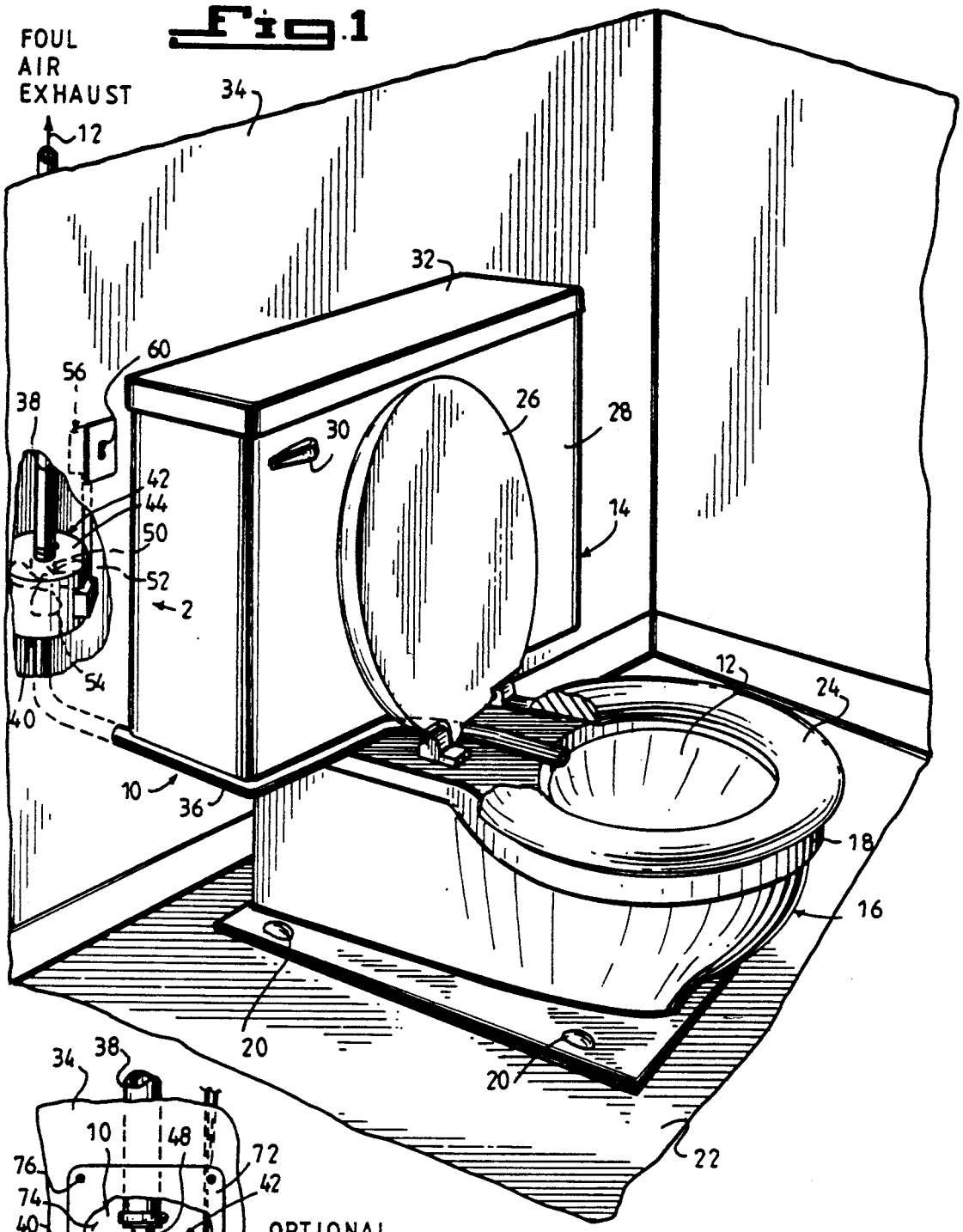
FIG. 1 is a perspective view of a toilet with parts broken away showing the instant invention installed therein.

Turning now descriptively to the drawings, in which similar reference characters denote similar elements throughout the several views, the Figures illustrate a device 10 for exhausting foul air 12 from a toilet 14 of the type having a bowl 16 with a rim 18, bolt caps 20 for mounting the bowl 16 to a floor 22, a seat 24 with a hinged cover 26 and a tank 28 with a flush handle 30 and tank lid 32 placed adjacent a wall 34. The device 10 consists of an intake hose 36 extending from the rear portion of the rim 18 of the bowl 16 below the seat 24 and hinged cover 26, bottom of the tank 28 and through the wall 34. An exhaust hose 38 extends upwardly within the wall 34. A mechanism 40 is coupled between the intake hose 36 and the exhaust hose 38 within the wall 34, for driving a current of air therethrough, so that the foul air 12 within the bowl 16 will be exhausted into the wall 34.

The air driving mechanism 40 is a blower 42 which includes a casing 44 having an inlet port 46 and an outlet port 48. The inlet port 46 is coupled to one end of the intake hose 36 within the wall 34 while the outlet port 48 is coupled to one end of the exhaust hose 38 within the wall 34. A fan 50 within the casing 44 has an electric motor 52 to rotate a plurality of thin rigid vanes 54 in order to drive the current of air therethrough, to carry the foul air 12 in from the inlet port 46 and out from the outlet port 48. The device 10 further includes a mechanism 56 for opening and closing an electrical circuit between a power supply 58 and the electric motor 52 of the fan 50 in the blower 42.

As best seen in FIG. 1, the electrical circuit opening and closing mechanism 56 is an on/off switch 60 mounted into the wall 34 and is electrically connected between the electric motor 52 of the fan 50 in the blower 42 and the power supply 58 so that a person can manually operate the on/off switch 60 to remove the foul air 12 from the bowl 16 of the toilet 14.

As best seen in FIGS. 4 to 6B, the electrical circuit opening and closing mechanism 56 is a pressure switch 62 mounted into the rim 18 of the bowl 16 below the seat 24. The pressure switch 62 is for connecting an electric current from a power supply 58 to the electric motor 52 of the fan 50 in the blower 42 to begin operation of the fan 50 when a person sits upon the seat 24 and for disconnecting the electric current to the electric motor 52 of the fan 50 in the blower 42 to cease operation of the fan 50 when the person gets off the seat 24.

The pressure switch 62 includes a flexible housing 64 extending upwardly between the rim 18 the seat 24. A first stationary electric contact 66 within the flexible housing 64 is electrically connected to the power supply 58 within the wall 34. A second movable electric contact 68 within the flexible housing 64 is electrically connected to the electric motor 52 of the fan 50 in the blower 42 and is normally spaced away from the first stationary electric contact 66. When the flexible housing 64 is compressed by the weight of the person sitting on the seat 24, the second movable electric contact 68 will engage the first stationary electric contact 66 for connecting the electric current from the power supply 58 to the electric motor 52 of the fan 50 in the blower 42. The flexible housing 64 is fabricated out of a soft compressible rubber material 70 to encompass the first stationary electric contact 66 and the second movable electric contact 68.

Figure 2:
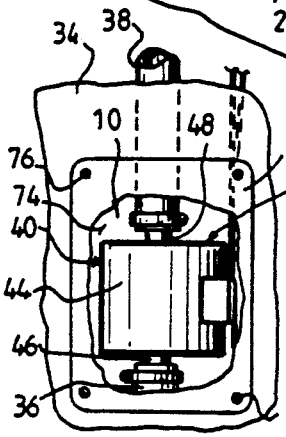
FIG. 2 is a front view taken in direction of arrow 2 in FIG. 1 of a portion of the wall with parts broken away showing an option removable access panel.

As shown in FIG. 2, the device 10 can further include an access panel 72 removably affixed to the wall 34 that has an aperture 74 therethrough adjacent the blower 42 so that the access panel 72 can cover the aperture 74 and when removed from the wall 34 the blower 42 can be repaired/replaced when needed. A plurality of mounting screws 76 extends through the access panel 72 and into the wall 34 for removably affixing the access panel 72 to the wall 34.

To use the device 10 with the on/off switch 60, a person simply turns on the on/off switch 60 while using the toilet 14. The blower 42 will go on to exhaust the foul air 12 that is within the bowl 16 into the wall 34 away from the person. The on/off switch 60 is then turned off by the person so that the person can leave the area of the toilet 14.

To use the device 10 with the pressure switch 62, a person simply sits upon the seat 24 in which the weight of the person will compress the flexible housing allowing the second movable electric contact 68 to engage with the first stationary electric contact 66. The blower 42 will go on to exhaust the foul air 12 that is within the bowl 16 into the wall 34 away from the person. When the person gets off the seat 24 the second movable electric contact 66 will move away from the first stationary electric contact 66. This will cause the blower 42 to go off so that the person can leave the area of the toilet 14.

LIST OF REFERENCE NUMBERS

10 device
12 foul air
14 toilet
16 bowl
18 rim on 16
20 bolt cap
22 floor
24 seat
26 hinged cover
28 tank
30 flush handle
32 tank lid
34 wall
36 intake hose
38 exhaust hose
40 air driving mechanism
42 blower
44 casing
46 inlet port
48 outlet port
50 fan
52 electric motor
54 thin rigid vane
56 electrical circuit opening and closing mechanism
58 power supply
60 on/off switch for 56
62 pressure switch for 56
64 flexible housing
66 first stationary electric contact in 64
68 second movable electric contact in 64
70 soft rubber material of 64
72 access panel
74 aperture in 34
76 mounting screw It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A device for exhausting foul air from a toilet of the type having a bowl with a rim, bolt caps for mounting the bowl to a floor, a seat with a hinged cover and a tank with a flush handle and tank lid placed adjacent a wall, said device including an intake hose extending from the rear portion of the rim of the bowl below the seat and hinged cover, bottom of the tank and through the wall, an exhaust hose extending upwardly within the wall, means coupled between said intake hose and said exhaust hose within the wall, for driving a current of air therethrough, so that the foul air within the bowl will be exhausted into the wall, said air driving means in a blower which includes a casing having an inlet port and an outlet port wherein said inlet port is coupled to one end of said intake hose within the wall, while said outlet port is coupled to one end of said exhaust hose within the wall, a fan within said casing, having an electric motor to rotate a plurality of thin rigid vanes in order to drive the current of air therethrough, to carry the foul air in from said inlet port and out from said outlet port, means for opening and closing an electrical circuit between a power supply and the electric motor of said fan in said blower, said electrical circuit opening and closing means is an on/off switch mounted into the wall and electrically connected between the electric motor of said fan in said blower and the power supply so that a person can manually operate said on/off switch to remove the foul air from the bowl of the toilet, said electrical circuit opening and closing means is a pressure switch mounted into the rim of the bowl below the seat for connecting an electric current from a power supply to the electric motor of said fan in said blower to begin operation of said fan when a person sits upon the seat and for disconnecting the electric current to the electric motor of said fan in said blower to cease operation of said fan when the person get off the seat, said pressure switch includes flexible housing extending upwardly between the rim and the seat, a first stationary electric contact within said flexible housing electrically connected to the power supply within the wall, and a second movable electric contact within said flexible housing electrically connected to the electric motor of said fan in said blower and normally spaced away from said first stationary electric contact, whereby when said flexible housing is compressed by the weight of the person sitting on the seat, said second movable electric contact will engage said first stationary electric contact for connecting the electric current from the power supply to the electric motor of said fan in said blower.

2. A device for exhausting foul air from a toilet of the type having a bowl with a rim, bolt caps for mounting the bowl to a floor, a seat with a hinged cover and a tank with a flush handle and tank lid placed adjacent a wall, said device including an intake hose extending from the rear portion of the rim of the bowl below the seat and hinged cover, bottom of the tank and through the wall, an exhaust hose extending upwardly within the wall, means coupled between said intake hose and said exhaust hose within the wall, for driving a current of air therethrough, so that the foul air within the bowl will be exhausted into the wall, said air driving means is a blower which includes a casing having an inlet port and an outlet port wherein said inlet port is coupled to one end of said intake hose within the wall, while said outlet port is coupled to one end of said exhaust hose within the wall, a fan within said casing, having an electric motor to rotate a plurality of thin rigid vanes in order to drive the current of air therethrough, to carry the foul air in from said inlet port and out from said outlet port, means for opening and closing an electrical circuit between a power supply and the electric motor of said fan in said blower, said electrical circuit opening and closing means is an on/off switch mounted into the wall and electrically connected between the electric motor of said fan in said blower and the power supply so that a person can manually operate said on/off switch to remove the foul air from the bowl of the toilet, said electrical circuit opening and closing means is a pressure switch mounted into the rim of the bowl below the seat for connecting an electric current from a power supply to the electric motor of said fan in said blower to begin operation of said fan when a person sits upon the seat and for disconnecting the electric current to the electric motor of said fan in said blower to cease operation of said fan when the person get off the seat, said pressure switch includes flexible housing extending upwardly between the rim and the seat, a first stationary electric contact within said flexible housing electrically connected to the power supply within the wall, and a second movable electric contact within said flexible housing electrically connected to the electric motor of said fan in said blower and normally spaced away from said first stationary electric contact, whereby when said flexible housing is compressed by the weight of the person sitting on the seat, said second movable electric contact will engage said first stationary electric contact for connecting the electric current from the power supply to the electric motor of said fan in said blower, said flexible housing is fabricated out of a soft compressible rubber material to encompass said first stationary electric contact and said second movable electric contact.

* * * * *